US005649488A

United States Patent [19]

Morrison et al.

[11] Patent Number: 5,649,488

[45] Date of Patent: Jul. 22, 1997

[54] NON-EXPLOSIVE TARGET DIRECTED REENTRY PROJECTILE

[75] Inventors: Alfred M. Morrison, Fulton; John S. Vamos, Silver Spring; William G. Dorsey, Ellicott City, all of Md.; W. Carson Lyons, Williamsburg, Va.

[73] Assignee: The United States of America as represented by the Secretary of the Navy, Washington, D.C.

[21] Appl. No.: 446,121

[22] Filed: May 19, 1995

Related U.S. Application Data

[63] Continuation-in-part of Ser. No. 266,402, Jun. 27, 1994, abandoned.

[51] Int. Cl.[6] ..... F42B 12/02

[52] U.S. Cl. ..... 102/518; 102/293; 102/393; 102/489; 244/117 A; 244/158 A

[58] Field of Search ..... 102/293, 393, 102/374, 489, 514–519; 244/117 A, 158 A

[56] References Cited

U.S. PATENT DOCUMENTS

| | | | |
|---|---|---|---|
| 2,724,334 | 11/1955 | Norton et al. | 102/518 |
| 3,026,806 | 3/1962 | Runton et al. | 244/158 A |
| 3,596,604 | 8/1971 | Corkery | 244/158 A |
| 3,795,196 | 3/1974 | Hillenbrand | 102/518 |
| 3,997,899 | 12/1976 | Rolsma | 244/158 A |
| 4,108,073 | 8/1978 | Davis | 102/518 |
| 4,340,197 | 7/1982 | Campbell | 244/158 A |
| 4,702,439 | 10/1987 | Kelly et al. | 244/158 A |
| 4,829,905 | 5/1989 | Lew et al. | 102/489 |
| 4,960,055 | 10/1990 | Dieval | 102/489 |
| 4,961,384 | 10/1990 | Sayles | 102/519 |
| 5,340,058 | 8/1994 | Holl et al. | 244/117 A |

FOREIGN PATENT DOCUMENTS

| | | | |
|---|---|---|---|
| 2261053 | 5/1993 | United Kingdom | 102/518 |
| WO90/00244 | 1/1990 | WIPO | 102/518 |

*Primary Examiner*—Harold J. Tudor

[57] ABSTRACT

The non-explosive core of a reentry projectile is fixedly positioned within a hollow casing of the projectile at a location maximizing conversion and transfer of kinetic energy to an earth bound target in response to the projectile's impact at a hypersonic velocity and at a steep impact angle to the surface of the earth. The hollow casing is formed of a material capable of withstanding high temperatures, therefore, not requiring any cooling and allowing for the hollow casing to be free of heat transfer medium that might otherwise impede the desired quick release of the core upon impact of the projectile. The core is in the form of a single dense metallic slug having a mass establishing a center of gravity and moments of inertia for the projectile as a kinetic energy warhead corresponding to that of an explosive or nuclear warhead without weapon system modification.

5 Claims, 1 Drawing Sheet

FIG.1
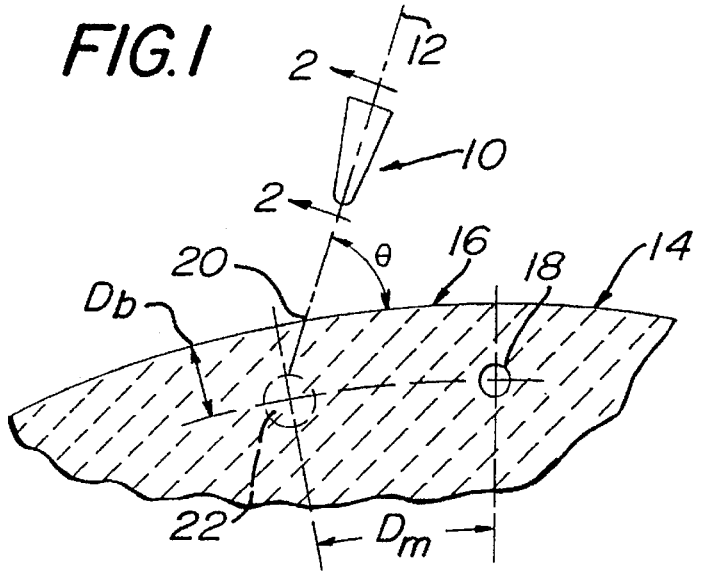
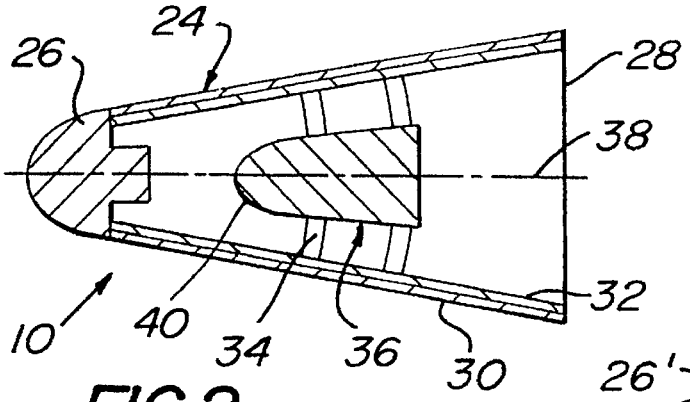
FIG.2
FIG.3
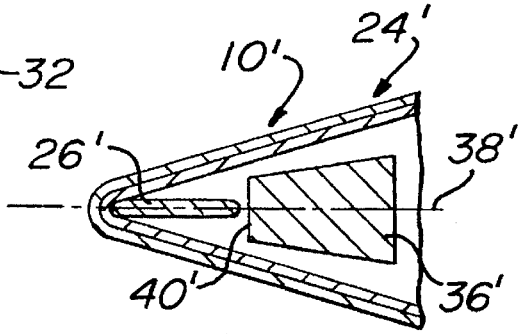
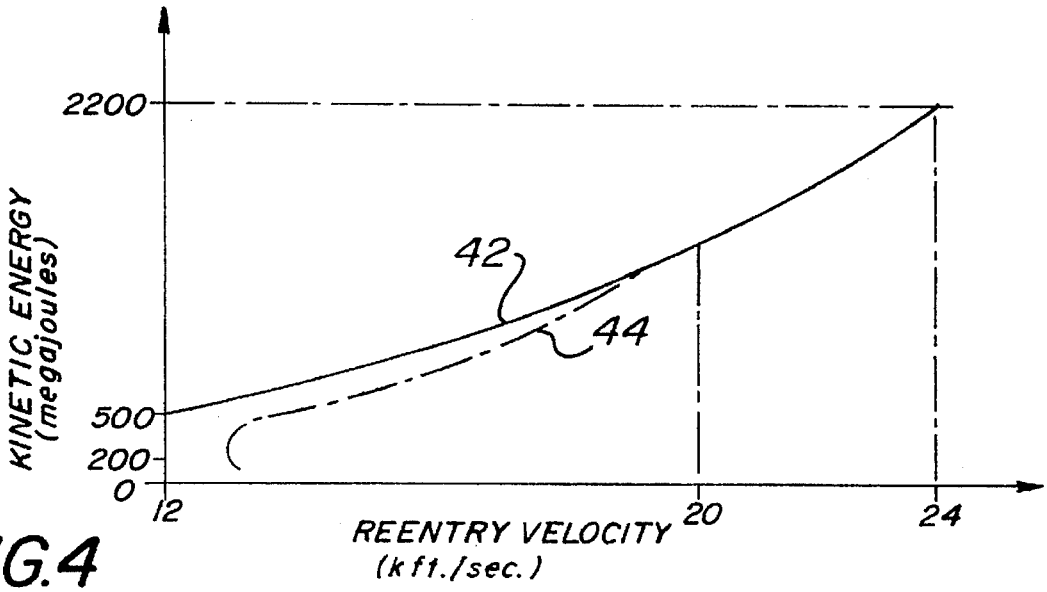
FIG.4

NON-EXPLOSIVE TARGET DIRECTED REENTRY PROJECTILE

CROSS-REFERENCE TO RELATED APPLICATIONS

This application is a continuation-in-part of U.S. patent application Ser. No. 08/266,402, filed Jun. 27, 1994, now abandoned.

STATEMENT OF GOVERNMENT'S INTEREST

The invention described herein may be manufactured or used by or for the Government of the United States of America for governmental purposes without the payment of any royalty thereon or therefor.

FIELD OF THE INVENTION

This invention relates generally to missile launched projectiles directed toward earth bound targets along a reentry path of travel for an impact induced release of energy.

BACKGROUND OF THE INVENTION

Reentry payloads launched from missiles and directed toward earth bound targets are well known including specific materials from which the payload core, nose portion and outer heat shield are made. Such payloads include projectiles in the form of explosive and nuclear warheads as well as elongated hydrodynamic penetrator rods. The foregoing reentry payload projectiles are respectively designed to address different target associated problems such as high collateral target damage to be imposed by nuclear warheads, break-up of anti-ballistic missile silos by long metal cylindrical penetrator rods and omni-directional release of energy from explosive warheads induced by detonation upon impact.

It is therefore an important object of the present invention to provide a more efficient reentry projectile capable of being flexibly designed to address problems associated with different classes of earth-bound targets.

An additional object of the invention is to provide a deployable reentry projectile of reduced weight that is compatible with existing missile launching systems to deliver an effective amount of targeted energy without reliance on nuclear warheads or explosives.

Further, it is an object of the present invention to allow the kinetic energy created upon impact of the projectile to be directed toward the intended target without being unnecessarily impeded by the structure of the projectile.

SUMMARY OF THE INVENTION

A single rigid and dense metallic slug forms the core of a non-explosive type of projectile having a casing made of a heat shield material with an inner lining providing the requisite aerodynamic and thermal properties accommodating severe hypersonic environments experienced by ballistic launched missiles during atmospheric reentry approach toward the earth along a trajectory having an impact angle approaching 90°. The high temperature material of the casing allows the casing to be hollow and free of any heat transfer medium. The mass and axial positioning of the core within the hollow casing of the projectile pursuant to the present invention is such that the center of gravity, moments of inertia and aerodynamic static margin of the projectile as a kinetic energy warhead correspond to that of a heavier explosive or nuclear warhead type of reentry missile without additional weapon system modification. Further, the forward end of the core is of a shape selected to provide maximized kinetic energy release and transfer to an earth bound target following impact of the projectile with the earth either at its surface or after penetration of the earth to some limited burial depth dependent on the class of target involved. The hollow casing, being free of any heat transfer medium, does not offer any unnecessary resistance to the desired quick release of the core upon impact of the projectile.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawings wherein:

FIG. 1 is a schematic side view illustration of a reentry projectile after launch approaching the surface of the earth along an impact trajectory path, in accordance with the present invention;

FIG. 2 is an enlarged side section view through the projectile shown in FIG. 1, in accordance with one embodiment of the invention;

FIG. 3 is a partial side section view corresponding to that of FIG. 2, in accordance with another embodiment of the invention; and FIG. 4 is a graph illustrating certain operational characteristics associated with reentry projectiles as shown in FIGS. 1–3.

DETAILED DESCRIPTION OF PREFERRED EMBODIMENTS

Referring now to the drawing in detail, FIG. 1 shows a projectile, generally referred to by reference numeral 10, during travel along an atmospheric reentry portion of a trajectory path 12 toward earth 14. The direction of the reentry path 12 is such as to intersect the surface 16 of the earth at a relatively steep impact angle approaching 90°. The projectile 10 could be deployed from a missile in the exoatmosphere by available launching equipment such as Trident submarine ballistic missiles, Minuteman and Peacekeeper intercontinental ballistic missiles or Tactical Theater reentry missiles.

With continued reference to FIG. 1, the projectile 10 is designed for impact with the earth 14 in order to convert and transfer kinetic energy to an earth-bound target 18. In the illustrated embodiment, the target 18 is of cylindrical shape buried a distance (Db) below the surface 16 of the earth. The projectile path 12 intersects the earth's surface at a point 20 spaced by a miss distance (Dm) from the target as diagrammed in FIG. 1. Thus, the projectile 10, after contact with earth at point 20, penetrates the earth to some depth often somewhat less than target burial depth (Db) in order to form a crater 22 from which impact converted kinetic energy is transferred by shock waves to exert maximum pressure on the target 18. In accordance with the present invention, conversion and transfer of an effective quantity of such kinetic energy to the target, induced by impact at hypersonic velocities, is maximized without use of explosives or nuclear energy.

Referring now to FIG. 2, the projectile 10 which is of generally conical shape has a hollow casing 24 extending axially from a forward nose tip 26 to a rear end 28. The casing 24 is formed by an outer heat shield material 30 having an underlining substrate 32 made of compositions well known in the art for enabling the projectile to survive severe atmospheric reentry environments, such as, temperatures in excess of 4000° F. and high axial and life aerodynamic loads, as well as to accommodate high hypersonic reentry velocities in excess of Mach Numbers greater than 5.0. Fixedly positioned within the hollow casing 24 by suitable mounting means 34 is a single unitary slug type of core 36 made of a relatively dense body of metal commonly utilized as such in the art.

The hollow casing 24, formed of a material capable of withstanding high temperatures, does not need any cooling thereof and, therefore, is free of any heat transfer medium, such as, a thermally conductive filler or paste, that might otherwise hinder the desired quick and non-impeded release of core 36 from its mounting means 34 of the projectile 10 impacting the ground. The hollow casing 24, free of any heat transfer medium, advantageously allows the kinetic energy created upon impact of the projectile 10, now being transferred by the core 36, to be directed toward its intended target without being impeded or diffused by any resistance that might otherwise be offered by a heat transfer medium within the hollow casing 24.

According to certain embodiments of the invention, the casing 24 formed by the outer heat shield 30 and substrate 32 is selected from known compositions that are relatively light (approximately 70 pounds) while the slug core 36 is selected from known compositions that are relatively heavy (approximately 130 to 330 pounds) by virtue of which the center of gravity of the projectile 10 is made to coincide substantially with that of the slug core 36 itself by appropriate axial positioning of the slug core within the hollow casing 24 along its axis 38, as depicted in FIG. 2. Based on such axial positioning of the slug core 36 and its after body shape, the center of gravity and moments of inertia of the projectile 10 may be made to correspond to that of a nuclear warhead so as to ensure that the projectile 10, as a kinetic energy warhead, can be directly substituted for the nuclear warhead without additional weapon system modification. The foregoing axial positioning of the slug core 36 within hollow casing 24 does not influence the amount of kinetic energy transferred upon impact and penetration of the earth along path 12 after demise of the hollow casing 24. Furthermore, as previously discussed, the hollow casing 24, being free of any heat transfer medium, does not impede the desired quick release of the slug core 36 upon impact of the projectile 10.

In the embodiment shown in FIG. 2, the forward end portion 40 of the core is tapered into an ogive shaped nose by reason of which the entry of the projectile 10 into the earth at the impact point 20 as aforementioned in connection with FIG. 1, delays the demise of the projectile casing 24 and releases maximum converted kinetic energy in the direction of projectile. Such released energy is laterally transferred by shock waves to the target 18 spaced from the projectile crater 22 by the miss distance (Dm) as aforementioned.

According to the embodiment illustrated in FIG. 3, an alternative projectile 10' is shown similar to the projectile 10 hereinbefore described including its nose tip 26' shown in side section. However, a differently shaped slug core 36' positioned along axis 38' of hollow casing 24', still free of any heat transfer medium, is provided having a flat-faced front end 40' selected to address another class of target. As a result of such flat-faced front end type of core 36', maximum energy release occurs substantially at the surface 16 of the earth in response to projectile impact, with minimal delay energy transfer to a target at the earth's surface 16. In a similar manner as discussed with reference to FIG. 2, the hollow casing 24', being free of any heat transfer medium, does not impede the desired quick release of the slug core 36' upon impact of the projectile 10'.

Based on the foregoing description, projectile 10 or 10' is made compatible as a reentry body interfaced with existing missile, fire control and launch tubes to effect impact induced release of converted kinetic energies as high as 2200 megajoules, which is the equivalent of 1000 pounds of conventional explosive. Further, the projectiles 10 and 10' each have a hollow casing 24 and 24', respectively, free of a heat transfer medium that might otherwise impede the desired quick release of the respective slug core 36 or 36'. Furthermore, the converted kinetic energy is released in the direction of projectile travel so as to apply more of such energy to the target as compared to the energy released by detonation of conventional explosives. For example, the cylindrical steel target 18 as diagrammed in FIG. 1 when buried a distance (Db) equal to 25 feet will be effectively damaged by the kinetic energy released by a projectile 10 of 350 pound weight penetrating the earth at a miss distance (Dm) of 113 feet from the target 18. The same target damage is effected by a 2200 pound conventional penetrating bomb.

The curve 42 in FIG. 4 graphically illustrates the kinetic energy release characteristics of 350 pound projectiles made in accordance with the present invention, demonstrating maximized release of energies as high as 2200 megajoules induced by impact with earth at an angle of 80° and at a projectile reentry velocity of up to 24K feet per second. Curve 44 in FIG. 4 reflects the achievement of maximized energy release at 6.29 megajoules per pound of the projectile mass by impact at reentry velocities above 20K feet per second for projectiles launched within a missile range of 1000 NM. More particularly, as previously described, the projectiles related to FIG. 4 have a mass of 350 pounds, and as seen in FIG. 4, the maximum reentry velocity of curve 44 at 24K feet per second corresponds to a kinetic energy of 2200 megajoules. Accordingly, the maximum energy (2200 megajoules) release for the projectile (350 pounds) is about 6.29 megajoules per pound (2200 megajoules/350 pounds).

Obviously, other modifications and variations of the present invention may be possible in light of the foregoing teachings. It is therefore to be understood that within the scope of the appended claims, the invention may be practiced otherwise than as specifically described.

What is claimed is:

1. In a projectile having a predetermined mass to be launched along a trajectory having an atmospheric reentry path of travel toward earth at a predetermined impact angle thereto, a hollow casing of heat shielding material for atmospheric reentry and a non-explosive kinetic energy core enclosed within the hollow casing, said hollow casing being free of any heat transfer medium; and mounting means fixedly positioning the core within the hollow casing free of any heat transfer medium, and said core spaced from said casing establishing an empty space between said casing and said core, for establishing a center of gravity of the projectile at a location therein maximizing conversion and transfer of kinetic energy during impact of the projectile with the earth at said predetermined impact angle.

2. The projectile as defined in claim 1, wherein said core is a unitary body having a forward end portion of a predetermined shape establishing said transfer of the kinetic energy relative to said predetermined mass of the projectile at 6.29 megajoules per pound.

3. The projectile as defined in claim 2, wherein the predetermined shape of the forward end portion of the core is ogive, whereby most of the kinetic energy transferred occurs upon penetration of the projectile at a limited penetration distance within the earth.

4. The projectile as defined in claim 2, wherein said core is a unitary metallic body.

5. The projectile as defined in claim 2, wherein the predetermined shape of the forward end portion of the core is flat.

* * * * *